United States Patent [19]

Reed

[11] Patent Number: 4,506,988

[45] Date of Patent: Mar. 26, 1985

[54] COMESTIBLE CONVERTING APPARATUS

[76] Inventor: Claude A. Reed, 4810 S. 136, Omaha, Nebr. 68137

[21] Appl. No.: 546,974

[22] Filed: Oct. 31, 1983

[51] Int. Cl.[3] ..... B01F 7/24

[52] U.S. Cl. ..... 366/203; 366/323

[58] Field of Search ..... 99/452; 220/1 C, 74; 222/108, 413; 248/318; 366/197, 198, 203, 204, 206, 207, 208, 212, 219, 279, 323

[56] References Cited

U.S. PATENT DOCUMENTS

| | | | |
|---|---|---|---|
| 2,209,057 | 7/1940 | Jackson | 222/108 |
| 2,565,426 | 8/1951 | Hayes | 366/204 |
| 2,626,132 | 1/1953 | Reed | 366/323 |
| 2,626,133 | 1/1953 | Reed | 366/206 |
| 3,061,279 | 10/1962 | Reed | 222/413 |

*Primary Examiner*—Robert W. Jenkins
*Assistant Examiner*—Arthur D. Dahlberg
*Attorney, Agent, or Firm*—G. Brian Pingel

[57] ABSTRACT

An improved apparatus for pressuring a hard frozen comestible, similar to hardened ice cream, while simultaneously subjecting it to mechanical action to reduce the crystal and cell structure of the material to transform it into a soft, smooth and creamy texture only slightly less cold than its starting temperature. The apparatus includes a hopper for receiving the hard frozen comestible to be treated, an auger positioned above the hopper and automatically actuated by movement of the hopper toward the auger to produce conditioning of the comestible by the auger as the hopper and auger move toward one another into an adjacent relationship. The hopper is supported on a saddle member, and vertical guide members are employed for supporting and guiding the saddle member during vertical movement thereof provided by linkage assembly. A sanitary receptacle member is semi-permanently connected to a support member such that the receptacle is normally positioned directly beneath the hopper to collect any waste product therefrom.

5 Claims, 7 Drawing Figures

FIG. 1
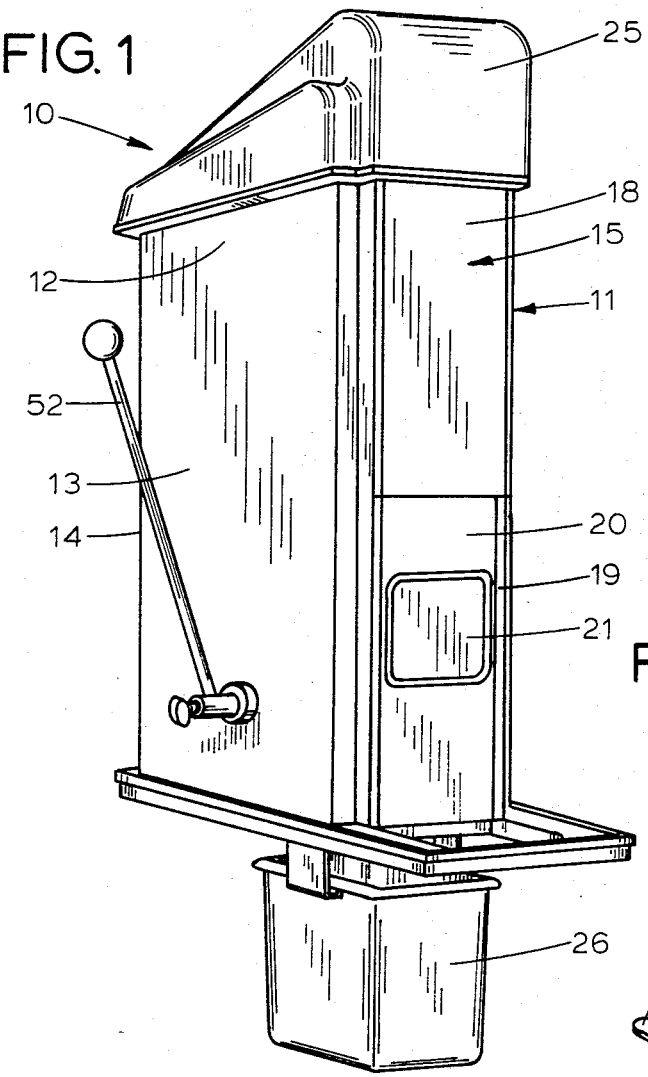
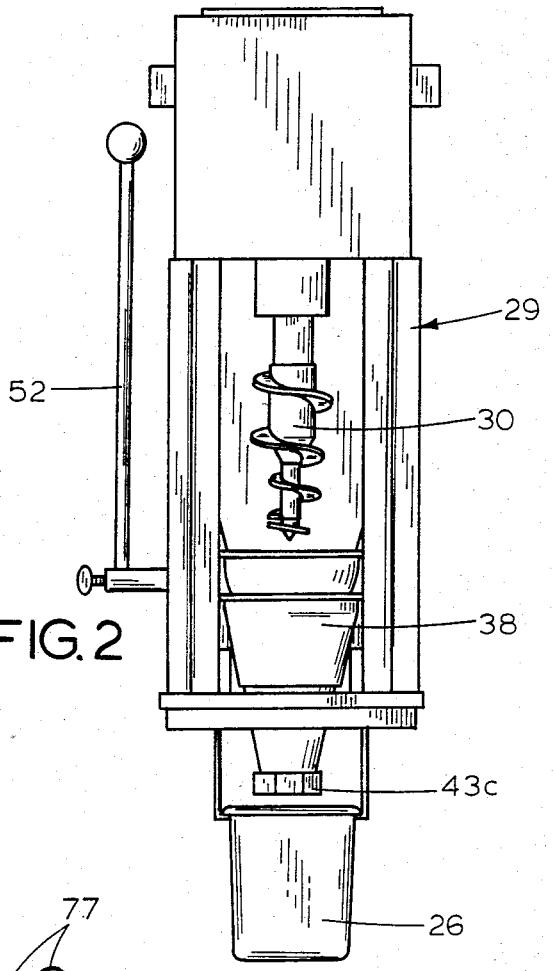
FIG. 2
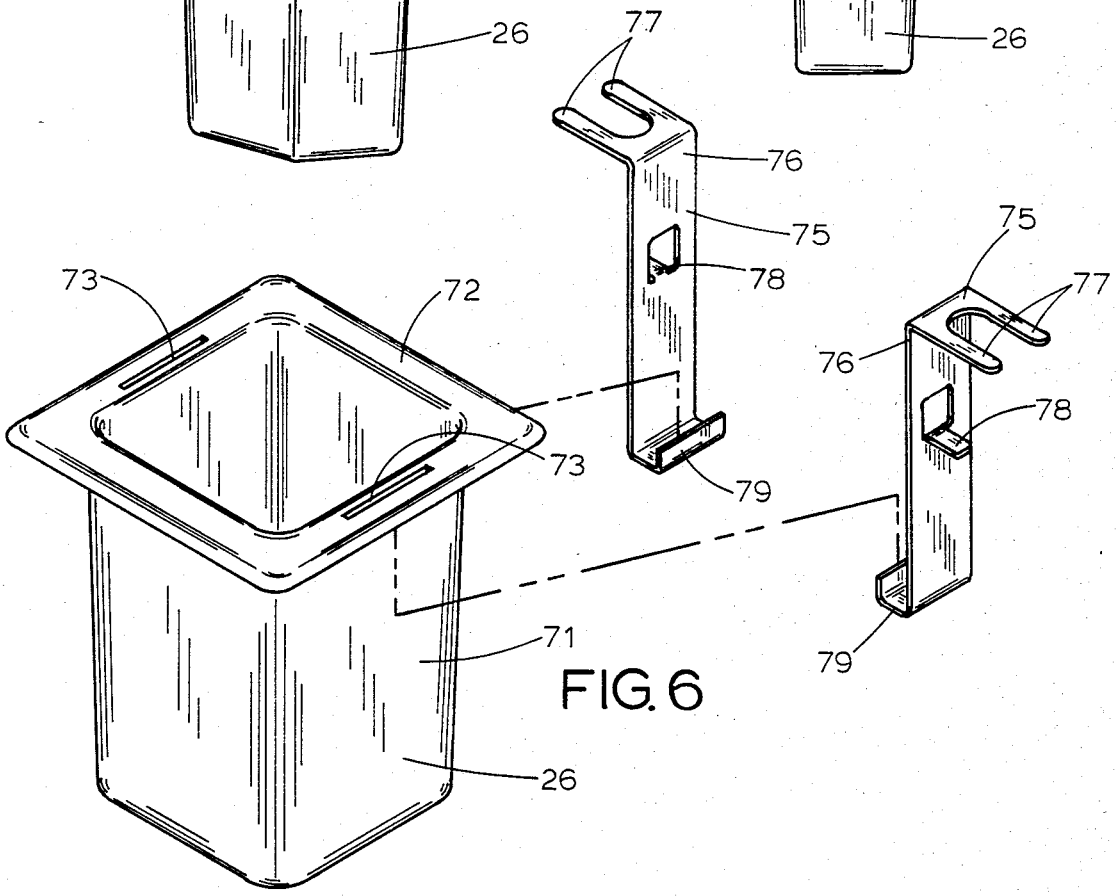
FIG. 6

COMESTIBLE CONVERTING APPARATUS

BACKGROUND OF THE INVENTION

1. Field of the Invention

The present invention relates to apparatus for processing semi-solid frozen comestibles into a smooth, soft and creamy texture, and relates more specifically to such apparatus that is adapted for rapid and thorough cleaning operations in order to comply with national sanitary requirements.

2. Description of the Prior Art

Apparatus of the type as generally described herein have been known in the prior art for several decades as shown and disclosed in applicant's prior U.S. Pat. Nos. 2,626,133, "Apparatus for Processing Frozen Comestibles" issued Jan. 20, 1953; 2,626,132, "Mixing Device for Frozen Comestibles" issued Jan. 20, 1953; and 3,061,279, "Apparatus for Processing Frozen Comestibles" issued Oct. 30, 1962.

In the above patents, the desirability of and equipment for transforming a hard frozen ice cream product to a product for consumption more closely resembling the soft, smooth, creamy and palatable condition of fresh frozen product was disclosed. Subsequent to such disclosure, apparatus made in accordance with the above patents have been employed in the United States and throughout Canada. However, because of certain deficiencies in the apparatus and process for transforming the frozen comestible, the prior art devices never became successful in the United States.

Recently, improvements have been made in the prior art devices to adapt them to a more marketable form in which the processing of frozen comestible may be accomplished in an economically feasible fashion, and yet comply in all respects with national requirements for sanitary conditions. In this respect, the prior art devices were deficient in that they were not able to conform to regulations and specifications set out by the National Sanitation Foundation and therefore their use was restricted in many instances. The present invention is adapted to provide a frozen comestible processing apparatus that operates as efficiently if not more effectively than prior apparatus, and yet can be readily and thoroughly cleaned of waste product to conform with the most rigid sanitary requirements.

SUMMARY OF THE INVENTION

The present invention provides an improved apparatus for converting a solid pre-frozen comestible to semi-solid condition having a soft, smooth and creamy texture and yet is only slightly less cold than the starting material. Preferrably, the apparatus is installed in a decorative, eye appealing cabinet that preferrably conceals a vertical structural frame for the apparatus. Upper and lower support members are affixed to the frame in a vertically spaced apart relation with a track means connected there between and a vertically aligned tapered auger rotatably mounted from the upper support member.

A vertically movable saddle means normally rests upon the lower support means and is associated with and guided by the track means upon actuation of a linkage means connected between the structural frame and the saddle means. A frusto-conically shaped hopper for receiving frozen comestible is seated upon the saddle means and includes a large upper opening and a lower narrow discharge opening and is in axial alignment with said auger so that as the saddle means is elevated through actuation of the linkage means, the hopper is raised to receive the auger in an operative relationship whereby the outer periphery of the auger is adjacent the interior of the hopper so that as the auger is driven, it advances the comestible in the hopper downwardly toward the lower opening thereof from which it exits in its smooth, soft and creamy texture. A sanitary receptacle member is semi-permanently suspended from the lower support means by connecting means that releasedly engage and hold the receptacle xember in a normal position directly beneath the lower end of the hopper for reception of any waste product therefrom.

In a preferred embodiment, the connecting means is formed of at least two elongated arm members having upper portions with vertically spaced apart clamping fingers for engaging the lower support member to semi-permanently retain each of the arm members thereon, and lower hook portions for engaging the receptacle member in a readily releasable fashion. The receptacle member has an exterior flange about its periphery that includes at least two spaced apart slots for receiving the hook portions of the connecting means arm members to effectively retain said receptacle member in its desired relationship to the hopper means.

To further facilitate the sanitary aspects of the present invention a lever means is attached to the linkage means via a wingnut and is readily removable therefrom without application of tools to remove the lever from the apparatus. Furthermore, the side members of housing of the apparatus are formed in single section stainless steel to eliminate cracks and crevices in which waste byproducts may reside.

DESCRIPTION OF THE DRAWINGS

FIG. 1 is a perspective front view of a preferred embodiment of the apparatus of the present invention for processing frozen comestibles particularly showing a housing and a sanitary receptacle suspended beneath the housing;

FIG. 2 is a froht view of the apparatus of FIG. 1 with a front panel of the housing removed to disclose the internal operating members thereof and particularly showing an auger below which is located a hopper supported by a vertically movable saddle member;

FIG. 6 is a perspective view of the sanitary receptacle member of FIG. 1 and connecting means therefore.

DESCRIPTION OF THE PREFERRED EMBODIMENT

Figure 3:
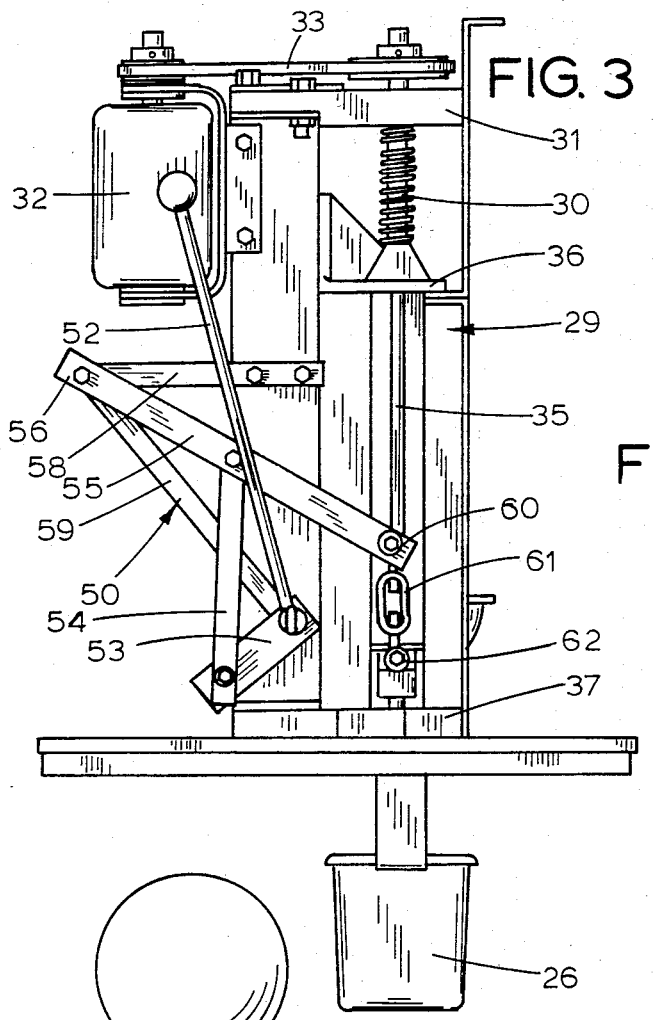
FIG. 3 is a side view of the apparatus of FIG. 1 with a rear cover portion of the housing removed to particularly show a linkage assembly for moving the saddle member and a motor for rotatably driving the auger shown in FIG. 2.

Referring now to the drawings and with reference first to FIG. 1, a preferred embodiment of an improved frozen comestible conditioning apparatus 10 of the present invention is shown. As described in my prior patents referred to in the Background of the Invention herein, which patents are incorporated herein by reference, the present invention provides a device for preferrably processing semi-solid frozen ice cream or ice milk by subjecting it to mechanical action which plasticized, needed and vigorously remixed the hard frozen product, thus reducing the crystal and cell structure of the material to thereby produce a soft, smooth and creamy texture, but with a temperature only slightly less cold than the starting temperature. Although the invention is described herein with respect to ice cream, it should be understood that the present invention is equally adaptable for use with ice milk, frozen yogurt and other comestibles.

The apparatus 10 preferrably includes an attractive styled housing 11 that serves to enclose all of the working components thereof and yet still provide for ready access to permit supply of frozen ice cream to the interior and receipt of the processed product after conditioning. The specific construction of the housing 11 is not crucial to the present invention. However, it is important that the sidewalls of the housing 11 are free of cracks or crevices in which waste material may lodge. Thus, preferrably, the housing 11 includes an integral three-sided cover member 12 that serves as the sidewalls 13 and rear wall 14 of the housing and is formed of stainless steel.

The front face of the housing 11 is provided by a one piece plate member 15 that includes an upper planer section 18 and lower leg members 19 and is connectible to the cover member 12. The one piece construction of the members 12 and 15 is particularly helpful in complying with sanitary regulations. A plastic panel member 20 fits within the space provided between the legs of the plate 15 and has a hinged door 21 for access to the housing interior.

A cover member 25 seals the upper portion of the housing 11 and the bottom of the housing is substantially open. However, the apparatus 10 is designed to sit atop a freezer containing frozen comestible product and having an interior compartment with an access opening for receiving a sanitary receptacle member 26 which extends beneath the housing 11 for a purpose that will be described later.

Referring now to FIGS. 2 and 3, the apparatus 10 is shown with the housing members 12 and 15 removed to reveal an interior structural frame 29 that serves to support in position the other internal components of the apparatus 10. As disclosed in my prior U.S. Pat. No. "279", the apparatus 10 includes an auger 30 suspended from an upper support arm 31 (FIG. 3) of the frame 29 and driven by an electrical motor 32 via a belt drive 33 (FIG. 3). The height of the auger 30 is fixed so it Will have no substantial vertical movement as it is rotatably driven by the motor 32. Thus, it is necessary for the device 10 to include an ice cream hopper that is lifted into position adjacent the auger 30 for processing of the ice cream, as will now be described.

Figure 4:
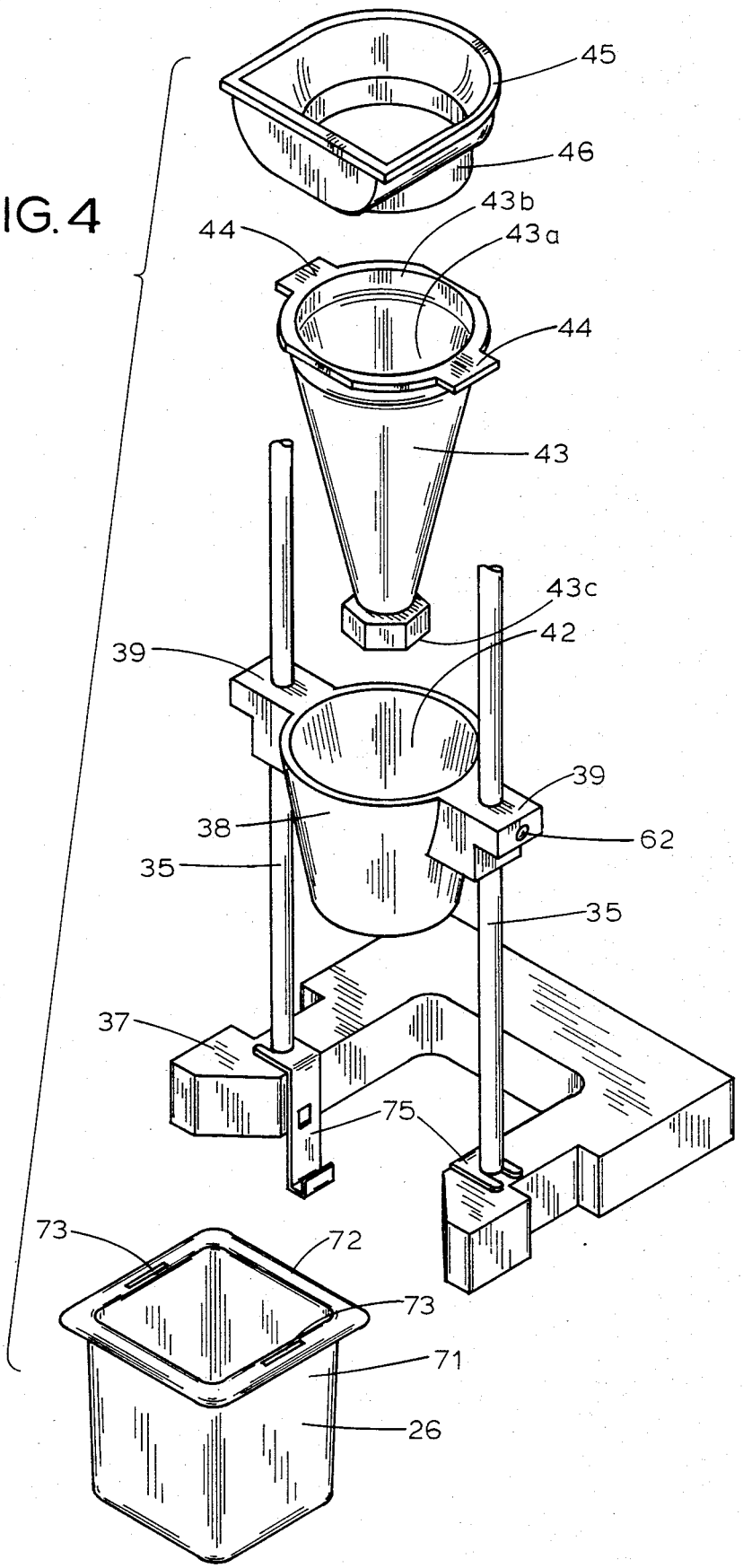
FIG. 4 is an exploded perspective view of certain interior components of the apparatus of FIG. 1 and particularly showing the movable saddle member, the hopper supported thereon, a filler guide for the hopper and the receptacle member.

The device 10 includes a pair of vertically aligned, spaced apart rods 35 fixed in place between a bottom support member 36 and upper support member 37 respectfully of the frame 29 (See FIGS. 3 and 4). Referring now to FIGS. 2 and 4, a saddle member 38 is provided in a guided relation to the rods 35 by means of ears 39 through which the rods 35 loosely extend. The saddle member 3B has a large central opening 42 for receiving a conically shaped hopper 43 (shown best in FIG. 4).

The hopper 43 is adapted for reception into the central opening 42 of the saddle 38 with flanges 44 on the upper periphery of the hopper serving as abutment members for seating on the upper periphery of the saddle member central opening 42. The hopper 43 has a central passageway 43(*a*) with a large upper opening 43(*b*) and a small opening 43(*c*) that must be small enough to hold the unprocessed ice cream in the hopper until it is conditioned. A loading funnel 45 has a neck portion 46 adapted to fit in the upper portion of the hopper 43 so that the member 45 can serve as a guide member for guiding frozen comestibles into the hopper 43.

Figure 5:
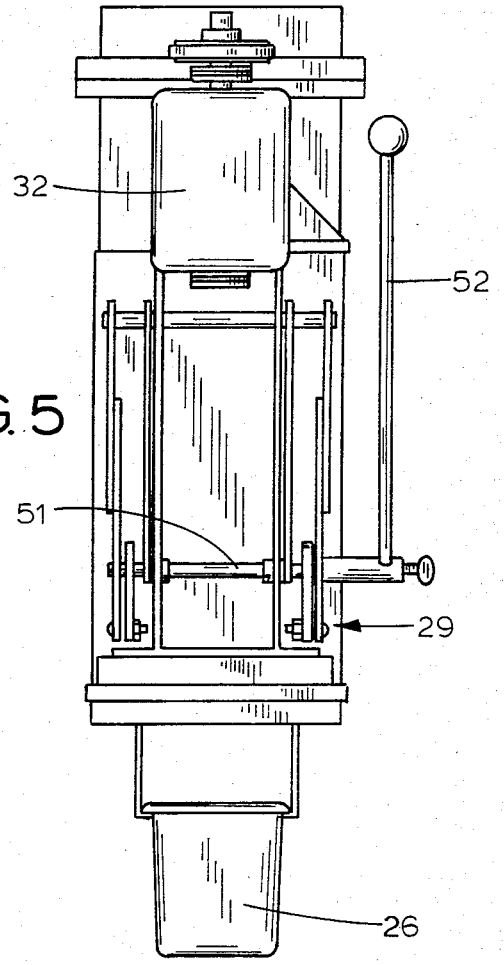
FIG. 5 is a rear view of the apparatus of FIG. 3.
Figure 7:
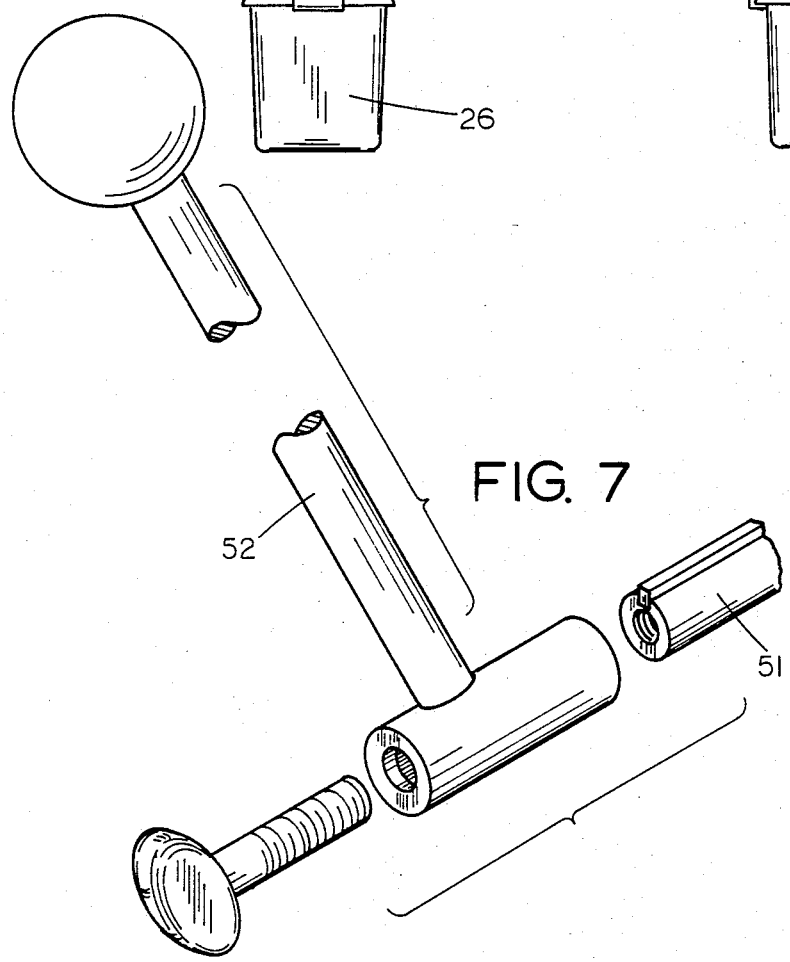
FIG. 7 is a perspective view of a handle member associated with the linkage means for actuating same.

To elevate the saddle member 38 and its associated hopper components, the device 10 includes a linkage assembly 50 (best shown in FIG. 3). The assembly 50 includes an axle member 51 (FIG. 5) journaled through the frame 29 and one end of which is attached to a lever 52 for providing selective actuation of the linkage assembly 50. Fixed to the axle 51 are a pair of link members 53 which move in a clockwise fashion upon forward movement of the lever 52. The opposite ends of the links 53 are pivotally connected to links 54 that interconnect the links 53 with yet another pair of links 55. Upper ends 56 of the links 55 are pivotally connected to two pairs of support struts 58 and 59 whereas lower ends 60 are each connected by a turn buckle 61 into a tapped hole 62 (FIG. 4) on each ear 39 of the saddle member 38.

As the link members 53 move in a clockwise fashion about the axle 51 upon forward movement of the lever 52, the link members 54 will move essentially in a vertical fashion to elevate the lower ends 60 of the links 55 and thereby raise the saddle member 38 and its associated hopper member 43 in a vertical direction toward the auger 30. As this upward movement occurs the motor driving the auger 30 is electrically activated as described in my prior "279" patent to begin rotation of the auger. As the hopper 43 is moved into a position whereby the flights of the auger 30 are adjacent the conical interior of the passageway 43(*a*) sidewall of the hopper 43 a processing action of any frozen comestible in the hopper 43 is provided to direct the comestible downward through bottom discharge opening 43(*c*) of the hopper in a soft, smooth texture into a dish or cup held beneath the hopper openings 43(*c*).

Thus, the apparatus 10 provides a convenient and efficient method for the processing of frozen comestibles. However, as can readily be recognized, through operation of the device 10 in processing comestibles, there will be a certain amount of waste or leftover product in the hopper 43 after a processing operation. As this leftover product begins to melt during operation of the application 10, the leftover material will drip into the freezer upon which the device 10 is positioned unless some means of collecting the product is provided. Accordingly, the present invention includes the sanitary receptacle member 26 for collecting waste or leftover product after each processing operation.

Referring again to FIG. 4, the sanitary receptacle member 26 is preferrably in the form of a stainless steel, open-top container 71 having a flange 72 around its upper peripheral edge. Formed in two opposite sides of the flange 72 are slots 73. Connecting means 75 are removably attached to the support member 37 to coact with the slots 73 to semipermanently suspend the receptacle member 26 beneath the saddle member 38. As shown best in FIG. 6, each connecting means 75 has an upper portion 76 with vertically spaced apart clamping fingers 77 and 78 that snugly fit about the support member 37 (FIG. 4). The connecting means 75, each also have a lower hook portion 79 for reception in one of the associated slots 73.

As indicated best in FIG. 2, the sanitary receptacle member 26 is suspended directly beneath the bottom opening 43(*c*) of the hopper member 43 when such member is in its normal rest position in a non-processing operation so that the receptacle member 26 catches any drips or spills from the hopper 43. In this way, no waste product can drip into the freezer or other such structure supporting the apparatus 10 to thereby create an unsanitary condition.

As can be seen from the above description, the receptacle member 26 is easily removable for emptying and cleaning operation. To further ensure the sanitary conditions of the apparatus 10, it should also be noted that the lever 52 is removable from the axle member 51 by means of a bolt with a wing-type head that can be removed by hand without resort to any special tools or in fact, tools of any kind. Thus, the lever 52 is readily removable from the axle 51 and this in turn means that the housing cover member 12 can be removed for access to the interior components of the apparatus 10 for additional cleaning operation. The present invention is thereby designed not only to provide a ready and efficient method for the processing of frozen comestibles, but does so in a manner that provides an optimum of sanitary conditions during operation and also for cleaning procedures of the machine after operation.

I claim:

1. An improved apparatus for converting a solid prefrozen comestible to semi-solid condition comprising:

a. a vertical structural frame;

b. an upper support means affixed to said frame;

c. a lower support means affixed to said frame below said upper support means in a spaced apart relation thereto and having a central opening;

d. a vertically aligned tapered auger rotatably mounted from said upper support member with its tapered most end pointing downwardly;

e. track means connected between said upper and lower support means;

f. a vertically movable saddle means that normally rests upon said lower support means and is associated with and guided by said track means, said saddle means having a body portion with a vertically aligned center bore;

g. linkage means connecting between said structural frame and said saddle means;

h. lever means rotatably mounted from said structural frame and movable to actuate said linkage means and thereby selectively control the vertical elevation of said saddle means from said lower support means;

i. a frusto-conically shaped hopper that receives said frozen comestible and includes an upper large opening and a lower narrow opening, said hopper being seated in the center bore of said saddle member in axial alignment with said auger in such fashion that as the saddle means is elevated by the actuation of said linkage means, the hopper is raised to receive the auger in an operative relationship whereby the outer periphery of the auger is adjacent the interior of the hopper;

j. means for turning said auger about a vertical axis during reception of the auger in said hopper to advance the comestible in the hopper downwardly toward the lower opening thereof;

k. a sanitary receptacle member; and l. connecting means semi-permanently attached to said lower support member and having lower ends that extend beneath said body portion of said saddle member to releasably engage and hold said receptacle member in a normal position directly beneath the lower open end of said hopper.

2. An improved comestible converting apparatus as recited in claim 1 wherein said connecting means is formed of at least two elongated arm xembers each having:

a. an upper portion with vertically spaced clamping fingers that engage said lower support member to semi-permanently retain each of said arm members thereon said support member;

b. a lower hook portion that engages said receptacle member; and c. a center portion connecting between said upper and lower portions.

3. An improved comestible converting apparatus as recited in claim 2 wherein said receptacle member has an exterior flange that includes at least two spaced apart slots for receiving the hook portions of said connecting means arm members.

4. An improved comestible converting apparatus as recited in claim 1 wherein said lever means is semipermanently mounted on said linkage means by means of a wingnut to facilitate normal cleaning of said apparatus.

5. An improved comestible converting apparatus as recited in claim 1 and further including an enclosure housing for said structural frame and associated components and having a front face plate adjacent said auger and formed from a unitary sheet of stainless steel to reduce to a minimum cracks and crevices in which said comestible may collect during normal operation of said apparatus.

* * * * *